US009742064B2

(12) United States Patent
Paulotto

(10) Patent No.: US 9,742,064 B2
(45) Date of Patent: Aug. 22, 2017

(54) LOW HEIGHT, SPACE EFFICIENT, DUAL BAND MONOPOLE ANTENNA

(71) Applicant: Maxtena, Inc., Rockville, MD (US)

(72) Inventor: Simone Paulotto, Rockville, MD (US)

(73) Assignee: Maxtena, Inc., Rockville, MD (US)

( * ) Notice: Subject to any disclaimer, the term of this patent is extended or adjusted under 35 U.S.C. 154(b) by 0 days.

(21) Appl. No.: 14/936,247

(22) Filed: Nov. 9, 2015

(65) Prior Publication Data

US 2016/0336653 A1 Nov. 17, 2016

Related U.S. Application Data

(60) Provisional application No. 62/076,666, filed on Nov. 7, 2014.

(51) Int. Cl.

| | |
|---|---|
| ***H01Q 1/36*** | (2006.01) |
| ***H01Q 5/371*** | (2015.01) |
| ***H01Q 5/392*** | (2015.01) |
| ***H01Q 1/48*** | (2006.01) |
| ***H01Q 9/04*** | (2006.01) |

(52) U.S. Cl.

CPC ..... *H01Q 5/371* (2015.01); *H01Q 1/48* (2013.01); *H01Q 5/392* (2015.01); *H01Q 9/0407* (2013.01); *H01Q 9/0421* (2013.01)

(58) Field of Classification Search

CPC ..... H01Q 5/392; H01Q 1/18; H01Q 9/0407; H01Q 1/36

See application file for complete search history.

(56) References Cited

U.S. PATENT DOCUMENTS 6,674,405 B2 * 1/2004 Wang ..... H01Q 1/243 343/700 MS 8,022,884 B2 * 9/2011 Dumon ..... H01Q 9/36 343/728

OTHER PUBLICATIONS

A Miniaturized Planar Space-filling Curve Antenna with Wideband Monopole-like Radiation Characteristics, John McVay and Ahmad Hoorfar, ECE Department, Villanova University, Villanova, PA 19085, ISBN: 1-4244-0123-2, 1-4244-0123-2/06/$20.00 © 2006 IEEE, pp. 3723-3726, Albuquerque, NM, USA, IEEE Antennas and Propagation Society International Symposium 2006, Jul. 9-14, 2006.

* cited by examiner

*Primary Examiner* — Hoang Nguyen

(74) *Attorney, Agent, or Firm* — Patents and Licensing LLC; Daniel W. Juffernbruch

(57) ABSTRACT

A low height, space efficient, dual band monopole antenna is provided. The antenna includes a first conductive post, a second conductive post and a third conductive post extending between a lower oblong shaped PCB and an upper oblong shaped PCB. A signal is applied to a bottom end of a first conductive post and bottom ends of the remaining two posts are coupled to ground. The top of the first post is connected to the tops of the second and third posts by a serpentine trace which in one embodiment is symmetric and in another embodiment is asymmetric. The asymmetric embodiment achieves improved dual band operation without the need for an impedance matching network.

25 Claims, 13 Drawing Sheets

| | |
|---|---|
| m6<br>freq=138.0MHz<br>S(1,1)=0.472 / -161.299<br>impedance = Z0 * (0.367 - j0.143) | m8<br>freq=148.1MHz<br>S(1,1)=0.296 / 137.459<br>impedance = Z0 * (0.599 + j0.263) |
| m5<br>freq=136.9MHz<br>S(1,1)=0.600 / -148.059<br>impedance = Z0 * (0.269 - j0.267) | m7<br>freq=150.0MHz<br>S(1,1)=0.134 / 11.749<br>impedance = Z0 * (1.299 + j0.072) |

LOW HEIGHT, SPACE EFFICIENT, DUAL BAND MONOPOLE ANTENNA

FIELD OF THE INVENTION

The present disclosure relates generally to antenna systems.

BACKGROUND

The Very High Frequency (VHF) band which ranges in frequency from 30 to 300 MHz corresponding to wavelengths in the range of 1 to 10 meters is suitable for direct line of sight radio communication including radio links from terrestrial radios to communication satellites.

A drawback of the VHF band is that the relatively large wavelengths call for a relatively large antenna. For example a ¼λ monopole sized for the lowest VHF wavelength of 1 meter would be 0.25 meters high and a ¼λ monopole antenna sized for a wavelength of 2 meter (corresponding to an existing satellite communication system) would be 0.5 meters high. Certain satellite communication systems specifically use vertically polarized signals meaning that the antenna, whatever its height, must be arranged vertically. For certain applications space for the antenna is limited and the aforementioned heights are unacceptable.

Thus what is needed is a reduced size VHF antenna.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure; however FIG. 1 and FIG. 10 are Computer Aided Design (CAD) drawings.

DETAILED DESCRIPTION

Figure 1:
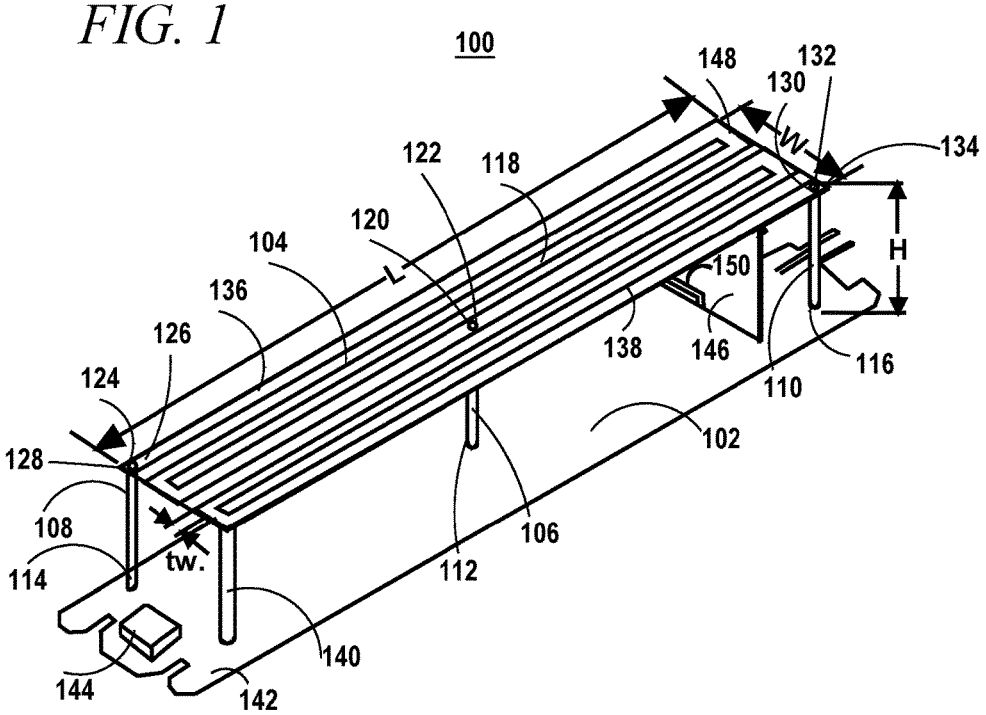
FIG. 1 is a perspective view of an antenna according to a first example described in this disclosure.
Figure 2:
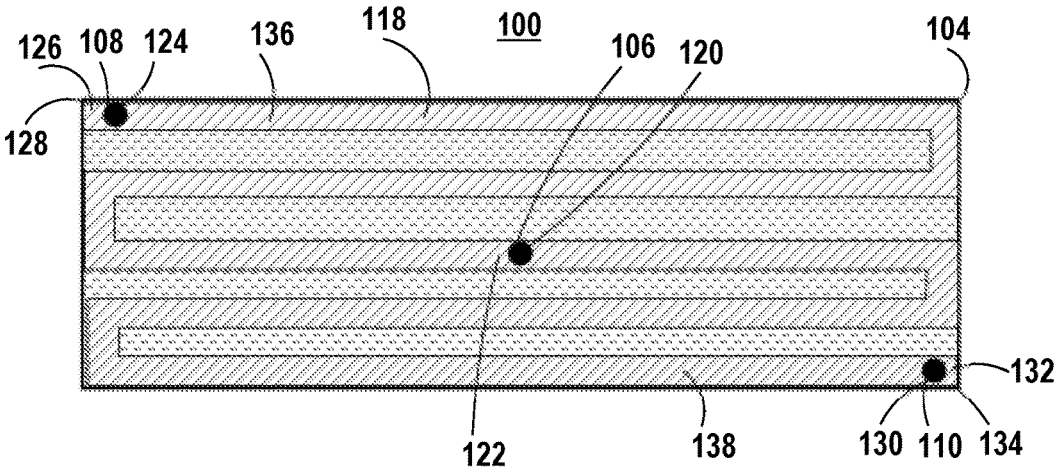
FIG. 2 is a top view of the antenna shown in FIG. 1.

FIG. 1 is a perspective view of an antenna 100 according to a first example discussed herein. The antenna 100 includes a bottom printed circuit board 102 and a top printed circuit board 104 overlying the bottom printed circuit board 102 in spaced relation therefrom. A transceiver circuit (not shown) and impedance matching network 400 (FIG. 4) can be positioned on the bottom printed circuit board 102. A top view of the top printed circuit board 104 is shown in FIG. 2. The top printed circuit board 104 has a length L and a width W which in the embodiment as shown are shared by the bottom board 102 although, alternatively the bottom printed circuit board 102 may have different dimensions. The antenna 100 has a height H which is equal to the spacing between the printed circuit boards 102, 104 plus their thickness.

A first conductive post 106, a second conductive post 108 and third conductive post 110 are each connected to both the bottom printed circuit board 102 and the top printed circuit board 104 and extend between the two printed circuit boards 102, 104. The first conductive post 106 includes a first end 112 that is located at the bottom printed circuit board 102. The first end 112 of the first conductive post 106 serves as a signal coupling port for the antenna 100 and is suitably coupled to the aforementioned transceiver through the aforementioned impedance matching network 400. A first end 114 of the second conductive post 108 and a first end 116 of the third conductive post 110 are both coupled to a ground 404

(FIG. 4) that is included in the bottom printed circuit board 102 as a metallization layer thereof.

A serpentine conductive trace 118 is formed on the top printed circuit board 104. A second end 120 of the first conductive post 106 is coupled (e.g., connected by solder) to the center 122 of the conductive trace 118. A second end 124 of the second conductive post 108 is coupled (e.g., connected by solder) to a first end 126 of the serpentine conductive trace 118 that is located at a first corner 128 of the top printed circuit board 104. A second end 130 of the third conductive post 110 is coupled (e.g., connected by solder) to a second end 132 of the serpentine conductive trace 118 that is located at a second corner 134 of the top printed circuit board 104. The second corner 134 is diagonally opposite from the first corner 128. The serpentine conductive trace can be viewed as including two portions (or "runs") including a first portion 136 that extends from its center 122 to the first end 126 and a second portion 138 that extends from the center 122 to the second end 132. In the case that the first portion 136 and the second portion 138 are formed from the same metal layer the first portion 136 and the second portion 138 are joined contiguously to each other. It is noted that the geometry of the second portion 138 is obtained by a 180° rotation of the first portion 136 about the position of the first conductive post 106. The symmetry of the serpentine trace 118 provides for cancellation of the effect of currents flowing in the two portions 136, 138 of the serpentine trace 118 such that the radiation of the antenna 100 is dominated by the currents flowing in the three posts 106, 108, 110.

The top printed circuit board provides an oblong area of a certain of length L and width Win which the serpentine trace 118 is confined. According to certain embodiments in order to achieve high volumetric space compression which may be defined as the wavelength of operation of the antenna divided by the cube root of the volume, the length to width ratio L/W for the area in which the serpentine trace is confined at least 2. In an exemplary embodiment the length L is 0.432 meters, the width W is 0.088 meters the height H is 0.076 meters, and the wavelength of operation is 2.09 meters, so that the volume of the antenna is 0.289e-2 cubic meters, the cube root of the volume is 0.143, and volumetric space compression is 14.6.

At least one portion (in the FIG. 1 embodiment the full length) of the serpentine conductive trace 118 has a width (denoted "tw" in FIG. 1), which according to certain embodiments, in order to improve bandwidth is between 0.05 and 0.1 times the width W of the oblong area in which the serpentine conductive trace 118 is confined.

As shown in FIG. 2, the first conductive post 106 is centered between the second conductive post 108 and the third conductive post 110, so that the distance between the second conductive post 108 and the third conductive post 110 is greater than the distance between the first conductive post 106 and the second conductive post 108 and greater than the distance between the first post 106 and the third conductive post 110. In the interest of symmetry and cancelation of currents in the serpentine trace 118, the distance between the first conductive post 106 and the second conductive post 108 is preferably within 10% of the distance between the first conductive post 106 and the third conductive post 110. For example, as shown the aforementioned two distances are equal.

The antenna 100 also includes two dielectric, mechanical support posts one of which 140 is visible in FIG. 1 and the other of which is located at a diagonally opposite corner from the one 140 which is visible in FIG. 1.

The antenna 100 is shown supported on a lower housing part 142. An oblong dielectric (e.g., plastic) antenna housing cover (not shown), also known as "radome", can be fitted onto the lower housing part 142 over the antenna 100. A second antenna in the form of a patch antenna 144 suitable for receiving Global Positioning Satellite (GPS) signals is supported on the lower housing part 142 adjacent to the antenna 100.

A third printed circuit board 146 is positioned near one end 148 of the antenna 100 facing in the longitudinal (L) direction of the antenna 100. A Planar Inverted "F" Antenna (PIFA) 150 is formed on the third printed circuit board and is useful for cellular network communications.

Figure 3:
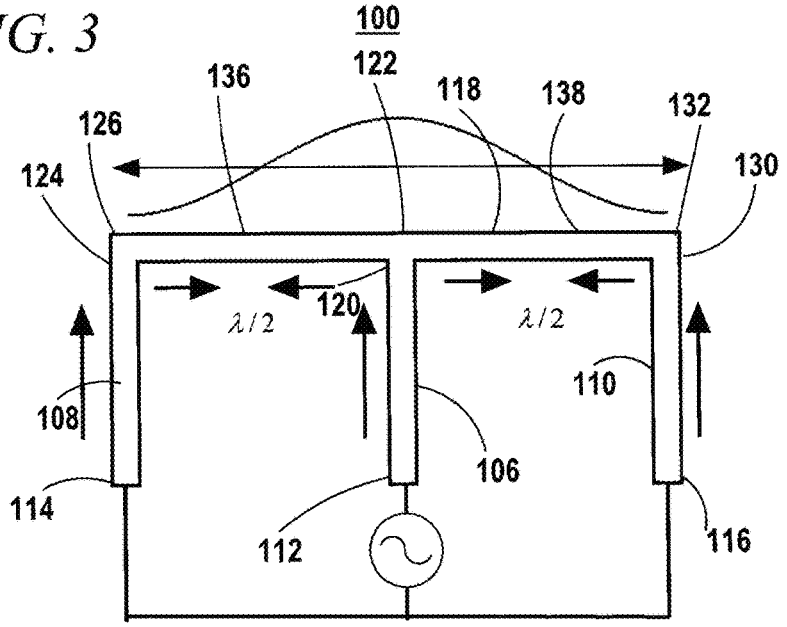
FIG. 3 is a schematic representation of the antenna shown in FIG. 1.

FIG. 3 is a schematic representation of the antenna 100 shown in FIG. 1. According to certain embodiments, the first portion 136 of the serpentine conductive trace 118 and the second portion 138 of the serpentine conductive trace 118 each have an electrical length of about one-half of the wavelength of operation of the antenna 100. More specifically, in certain embodiments the aforementioned electrical length is between 0.45λ and 0.55 λ, for example in the embodiment shown the electrical length is 0.5λ. When a signal source 302 (e.g., transceiver) is coupled to the first end 112 (signal coupling port) of the first conductive post 106, currents will be generated in each of conductive posts 106, 108, 110 that are in phase with each other and thus constructively contribute to monopole-like radiation from the antenna 100. The currents in the two portions 136, 138 of serpentine trace 118 are mirror images of each other and thus their effect in producing radiation cancel. The arrows in FIG. 3 represent current flow. At the top of FIG. 3 is a plot of the cosine function. The horizontal double head axis is the zero level for the cosine function. The spatial variation of the current along the serpentine trace 118 is approximated by the cosine function centered at the center 122 of serpentine trace. Thus, the antenna 100 is able to operate with an efficiency comparable to a significantly taller monopole while being able to fit within height constrained spaces.

Figure 4:
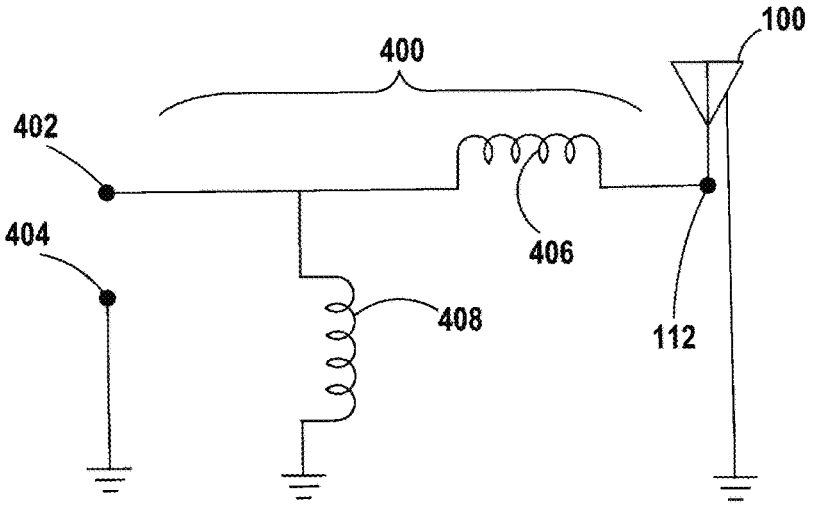
FIG. 4 is a schematic of a matching network used in the antenna shown in FIG. 1.

FIG. 4 is a schematic of a matching network 400 used in the antenna shown in FIG. 1. The matching network 400 comprises a first signal input terminal 402 and a second (grounded) signal input terminal 404. The first signal input terminal 402 is coupled through a first (series) inductor 406 to the first end 112 of the first conductive post 106 which serves signal coupling port for the antenna 100. The first signal input terminal 402 is also coupled through a second (shunt) inductor 408 to ground.

Figure 5:
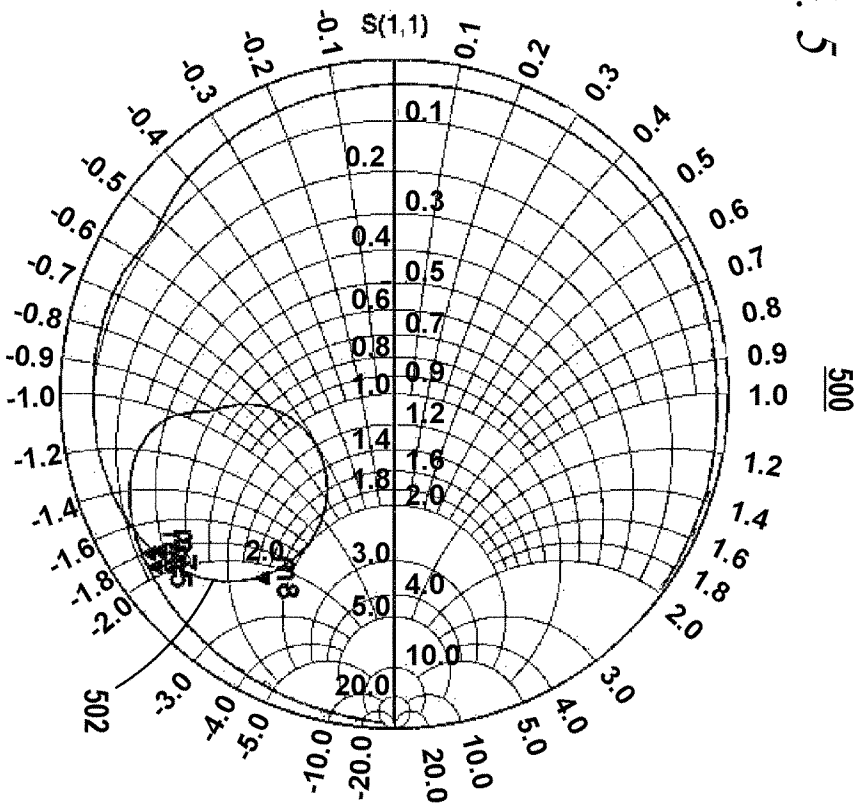
FIG. 5 is a first Smith chart showing the performance of the antenna shown in FIG. 1 without the matching network shown in FIG. 3.
Figure 6:
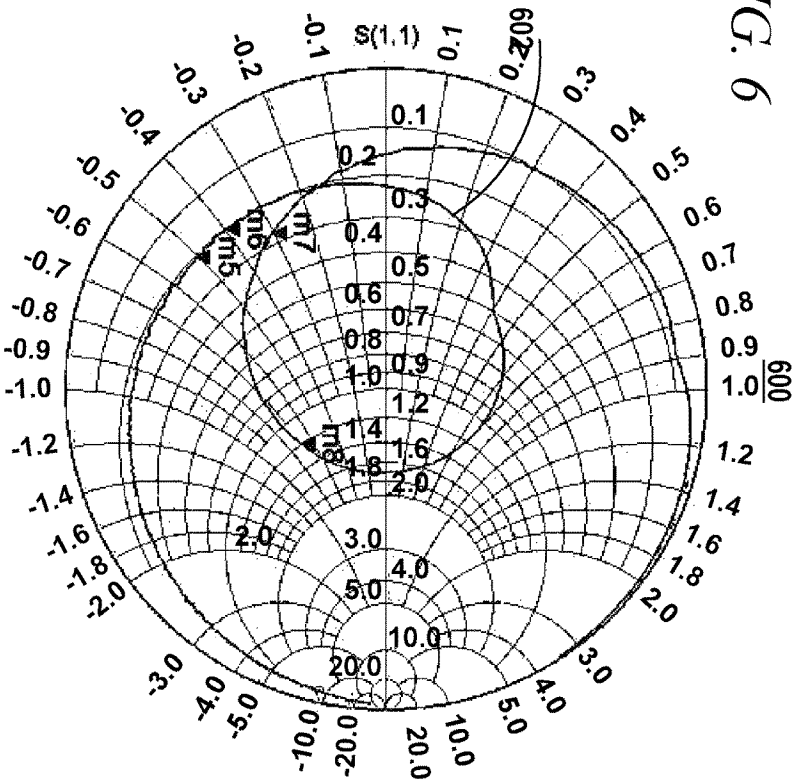
FIG. 6 is a second Smith chart showing the performance of the antenna shown in FIG. 1 with only the series inductor of the matching network shown in FIG. 3.
Figure 7:
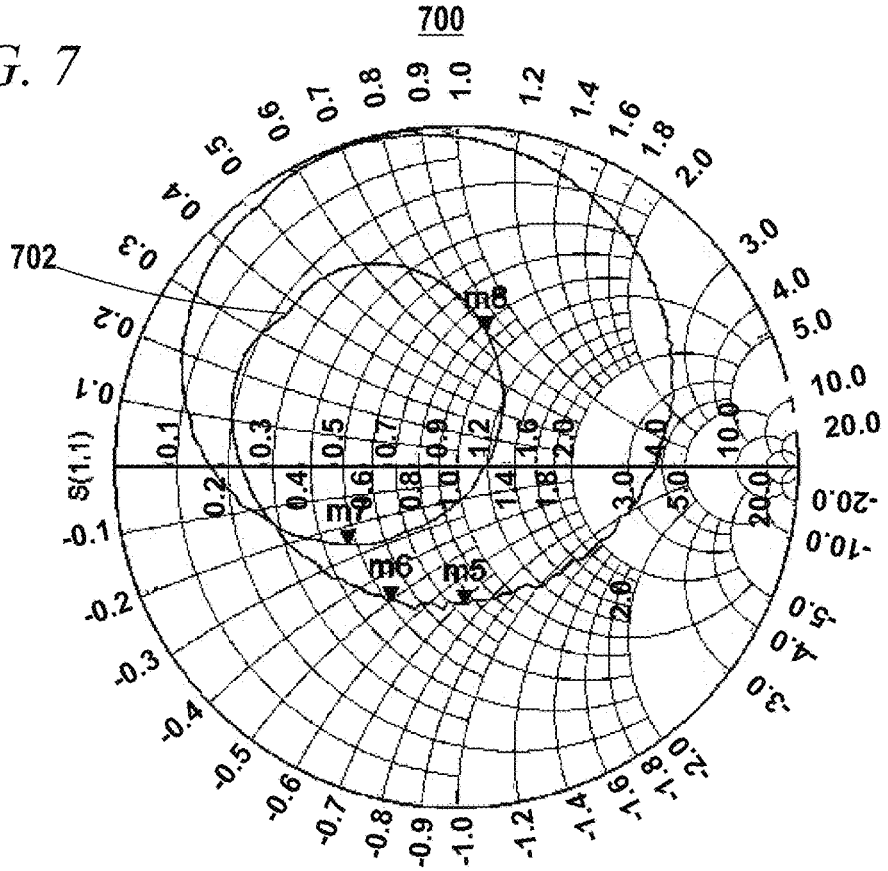
FIG. 7 is a third Smith chart showing the performance of the antenna shown in FIG. 1 with the complete matching network shown in FIG. 4.

FIGS. 5-7 show a series of Smith charts 500, 600, and 700 illustrating the effect of adding the components of the impedance matching network 400 shown in FIG. 4. In a Smith chart, the center of the chart represents an ideal case in which there is no signal reflection and the distance from the center indicates the magnitude of the reflection coefficient.

FIG. 5 is a first Smith chart 500 showing the performance of the antenna shown in FIG. 1 without the matching network shown in FIG. 3. The first Smith chart 500 includes a first plot 502 of operating point versus frequency. The correspondence of the frequency markers m5, m6, m7 and m8 shown to frequency for FIG. 5 and also for the Smith charts shown in FIG. 6 and FIG. 7 is shown in the table below.

TABLE

| Marker | Frequency (MHz) |
|---|---|
| M5 | 136.9 |
| M6 | 138.0 |
| M7 | 150 |
| M8 | 148.1 |

The frequencies of 136.9 MHz and 138 MHz approximately bound a receive band of the commercial Orbcomm™ satellite system and the frequencies 148.1 MHz and 150 MHz approximately bound a transmit band of the commercial Orbcomm™ satellite system.

In FIG. 5 markers m5, m6 and m7 are overlapping. By way of clarification, markers m6 and m5 point to positions outside the loop formed by the Smith chart plot line, while m7 points to a position inside the plot line loop. Without the matching network, as shown in FIG. 5 all of the frequency markers are well away from the center of the Smith chart-the position of an ideal impedance match.

FIG. 6 is a second Smith chart 600 showing the performance of the antenna 100 shown in FIG. 1 with only the series inductor 406 of the matching network shown in FIG. 4. The second Smith chart 600 includes a second plot 602 of operating point versus frequency. As shown in FIG. 6 adding the series inductor 406 reduces the maximum distance (magnitude of the reflection coefficient) of the frequency markers from the center of the Smith chart so that the antenna will operate more efficiently.

FIG. 7 is a third Smith chart 700 showing the performance of the antenna shown in FIG. 1 with the complete matching network shown in FIG. 4. The third Smith chart 700 includes a third plot 702 of operating point versus frequency. Adding the shunt inductor 408 again reduces the maximum distance of any of the frequency markers from the center of the Smith chart, relative to what is shown in FIG. 6 in the case that only the series inductor 406 is used.

Figure 8:
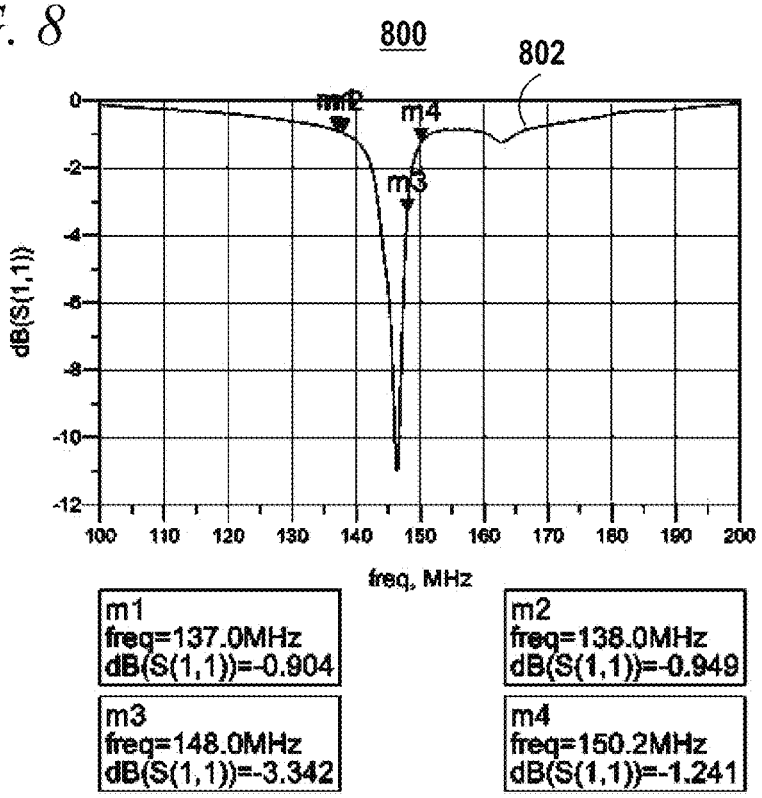
FIG. 8 is a return loss plot for the antenna shown in FIG. 1 without the matching network shown in FIG. 4.
Figure 9:
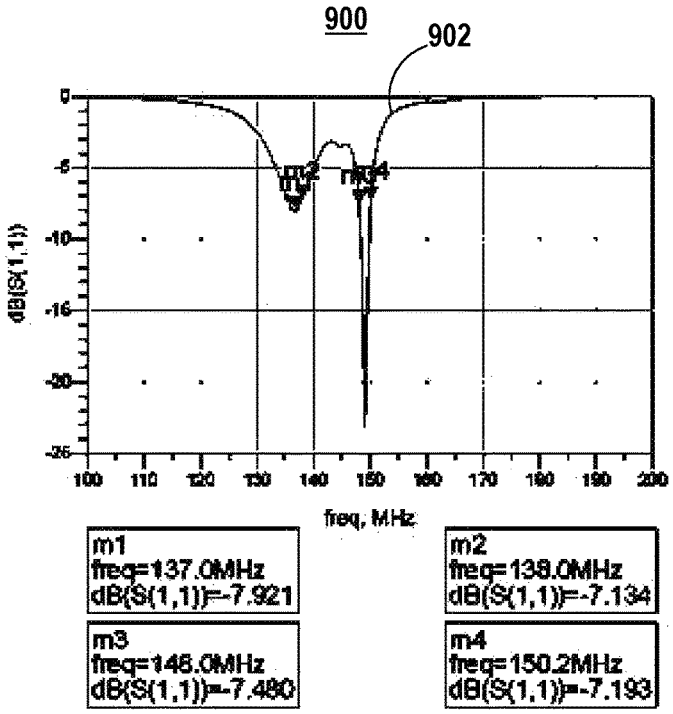
FIG. 9 is a return loss plot for the antenna shown in FIG. 1 with the matching network shown in FIG. 4.

FIGS. 8-9 show return loss plots comparing the performance of the antenna 100 shown in FIG. 1 with and without the impedance matching network 400 shown in FIG. 4. FIG. 8 is a graph 800 including a return loss plot 802 for the antenna 100 shown in FIG. 1 without the matching network 400 shown in FIG. 4 and FIG. 9 is a graph 900 including a return loss plot 902 for the antenna shown in FIG. 1 with the matching network shown in FIG. 4. Frequency markers m1, m2, m3 and m4 corresponding to the aforementioned frequency bands of the commercial Orbcomm™ satellite system are shown in FIG. 8 and FIG. 9. As shown in FIG. 8 the return loss at the frequency markers is relatively high up on the graph 800 indicating poorer performance, whereas as shown in FIG. 9 the return loss has greater magnitude negative values indicating less reflected power and hence improved performance relative to the case shown in FIG. 8.

Figure 10:
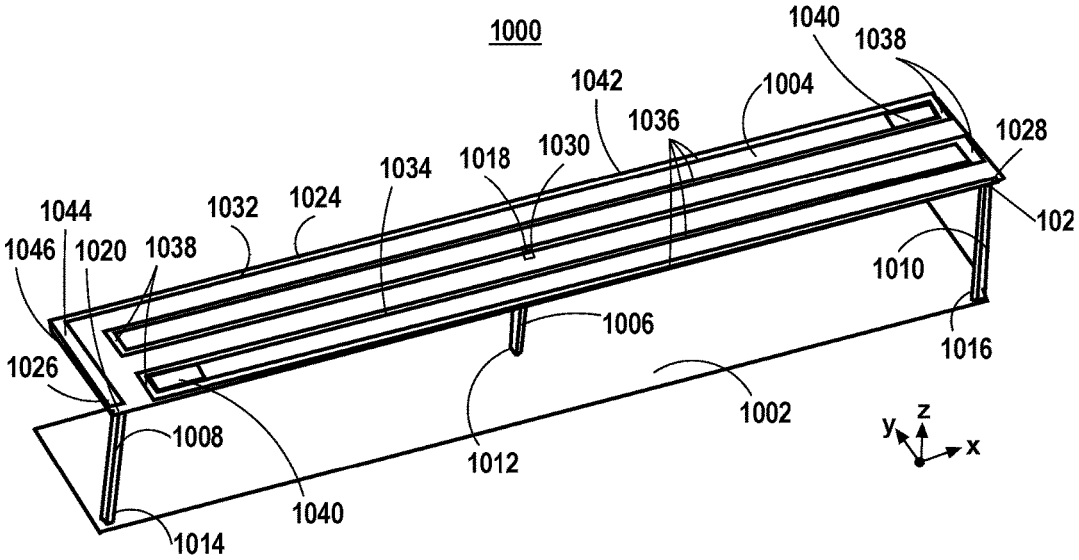
FIG. 10 is a perspective view of an antenna according to a second example described in this disclosure.
Figure 11:
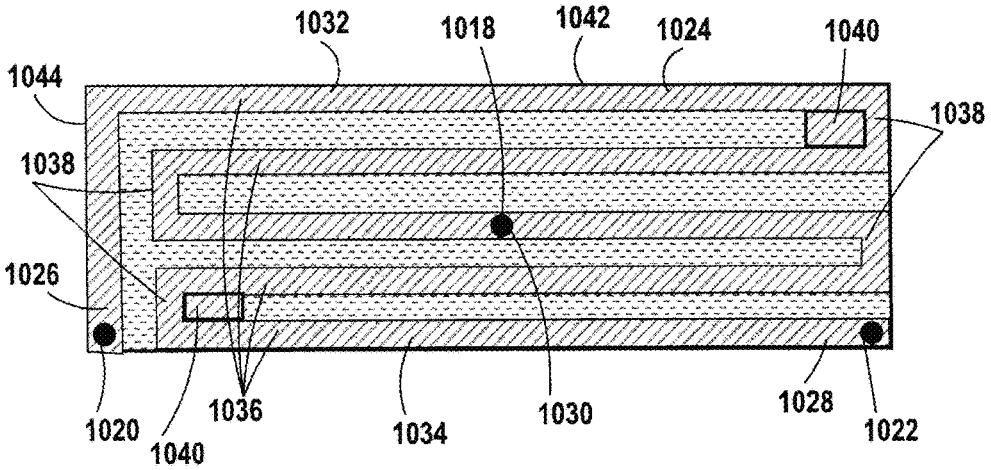
FIG. 11 is a top view of the antenna shown in FIG. 10.

FIG. 10 is perspective view of an antenna 1000 according to a second embodiment of the disclosure and FIG. 11 is a top view of the antenna 1000 shown in FIG. 10. The antenna 1000 includes a bottom printed circuit board 1002 and a top printed circuit board 1004. A first conductive post 1006, a second conductive post 1008 and a third conductive post 1010 extend between the bottom printed circuit board 1002 and the top printed circuit 1004. A first end 1012 of the first conductive post 1006, a first end 1014 of the second conductive post 1008 and a first end 1016 of the third conductive post 1010 are located at the bottom printed circuit board 1002. The first end 1014 of the second conductive post 1008 and the first end 1016 of the third conductive post 1010 connect to a ground plane layer (not distinctly visible) that is incorporated into the bottom printed circuit board 1002. The first end 1012 of the first conductive post 1006 serves as a signal coupling port of the antenna 1000. A second end 1018 of the first conductive post 1006, a second end 1020 of the second conductive post 1008 and a second end 1022 of the third conductive post 1010 are located at the top printed circuit board 1004.

A serpentine trace 1024 is formed on the top printed circuit board 1004. As shown, the serpentine trace 1024 includes a first end 1026 that is coupled (e.g., solder connected) to the second end 1020 of the second conductive post 1008. The serpentine trace 1024 further includes a second end 1028 that is coupled (e.g., solder connected) to the second end 1022 of the third conductive post 1010. An intermediate point 1030 on the serpentine trace 1024 is connected to the second end 1018 of the first conductive post 1006. In certain embodiments including the embodiment shown in FIG. 10, the intermediate point 1030 does not bisect the serpentine trace 1024 into two parts of equal path length. A first portion 1032 of the serpentine trace 1024 extends between the first end 1026 and the intermediate point 1030 and a second portion 1034 of the serpentine trace 1024 extends between the second end 1028 and the intermediate point 1030.

Most of the length of the serpentine trace 1024 is made up of longitudinal segments 1036 that extend parallel to the length direction of the antenna 1000 (parallel to the X-axis of the coordinate triad shown in FIG. 10). The longitudinal segments 1036 are connected by shorter cross segments 1038. Another way of describing this is that the x-component of the direction of the path of the serpentine trace 1024 integrated over the path of the serpentine trace is larger than the y-component of the same. In certain embodiments it is preferred that the integrated x-component exceed the integrated y-component by at least a factor of 5. Tuning patches 1040 are located between adjacent longitudinal segments 1036 adjacent two of the cross segments 1038. These tuning patches can be trimmed in a prototype in order to tune the antenna 1000 by effectively changing the length of the first portion 1032 and the second portion 1034 of the serpentine trace 1024.

The first portion 1032 generally meanders from the intermediate point 1030 toward a back side 1042 (in the perspective of FIG. 10) of the antenna 1000 but has a long cross segment 1044 that crosses along a first end 1046 of top PCB 1004 to a front left corner at which the first end 1026 of the serpentine trace 1024 is located. In this embodiment, this configuration makes the length of the first portion 1032 of the serpentine trace 1024 greater than the length of the second portion 1034. According to certain embodiments the length of the first portion 1032 of the serpentine trace is larger than the second portion 1034 of the serpentine trace by a factor of between 1.1 and 1.3 inclusive. For example in the embodiment shown in FIG. 10 the ratio of the lengths of the first portion 1032 to the second portion 1034 is 1.1. If the ratio is too low the second mode discussed below is not obtained and if the ratio is too high the first mode discussed below is lost. This asymmetry is important in establishing a second mode of the antenna that is discussed below with reference to FIG. 16. As in the case of the antenna 100, the serpentine trace 1024 is confined to an oblong area corresponding to the top printed circuit board 1004. The oblong area has an oblong area width and an oblong area length. According to certain embodiments each of the first portion (run) 1032 of serpentine conductor and the second portion 1034 (run) of serpentine conductor includes at least two segments that span at least 75% of the oblong area length and the first portion (run) 1032 of serpentine conductor includes a segment that spans at least 75% of oblong area width.

Figure 12:
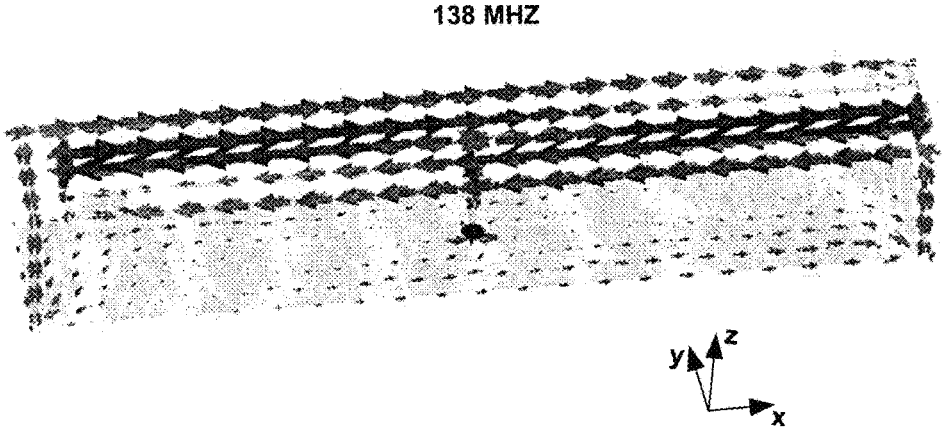
FIG. 12 shows a current distribution on the antenna shown in FIG. 10 at an instant in time for a first mode corresponding to a first frequency of operation.

According to an alternative embodiment, the serpentine trace could be made up primarily of segments that cross the top PCB 1004 in the width (Y-axis) direction which are connected by shorter segments extending in the length (X-axis) direction FIG. 12 shows a current distribution on the antenna shown in FIG. 10 at an instant in time for a first mode corresponding to a first frequency (e.g., the 137-138 MHz band) of operation. The first mode is similar to the mode of operation of the first antenna 100 which is illustrated in FIG. 3. The radiation of the first mode is dominated by current flowing in three conductive posts 1006, 1008, 1010, with some contribution by current flowing in the long cross segment 1044. There is a substantial symmetry cancellation effect among currents flowing in other parts of the serpentine trace 1024.

Figure 13:
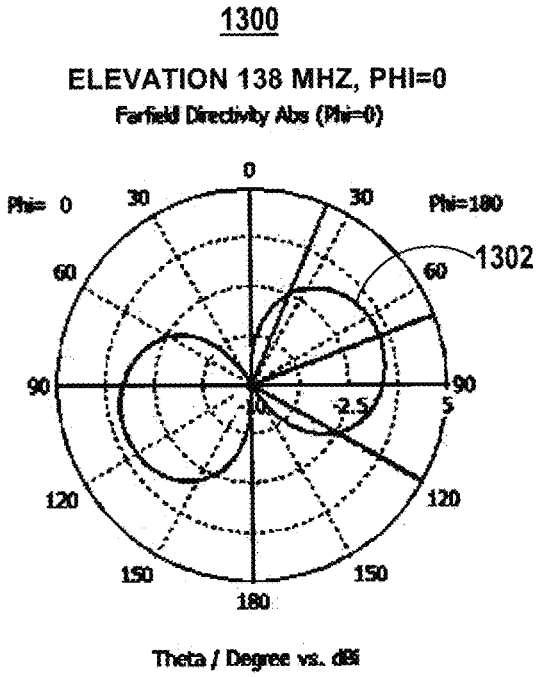
FIG. 13 is a graph including a polar plot of directivity vs elevation angle in a first cut plane for the antenna shown in FIG. 10 when operating in the first mode.
Figure 14:
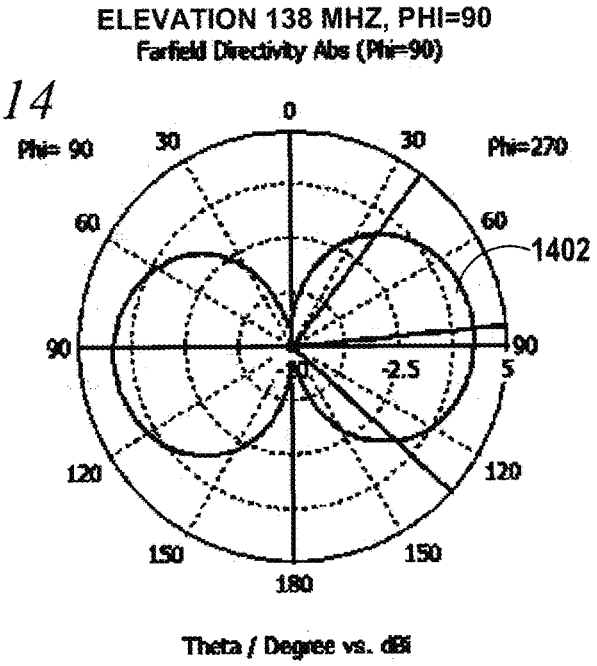
FIG. 14 is a graph including a polar plot of directivity vs elevation angle in a second cut plane for the antenna shown in FIG. 10 when operating in the first mode.
Figure 15:
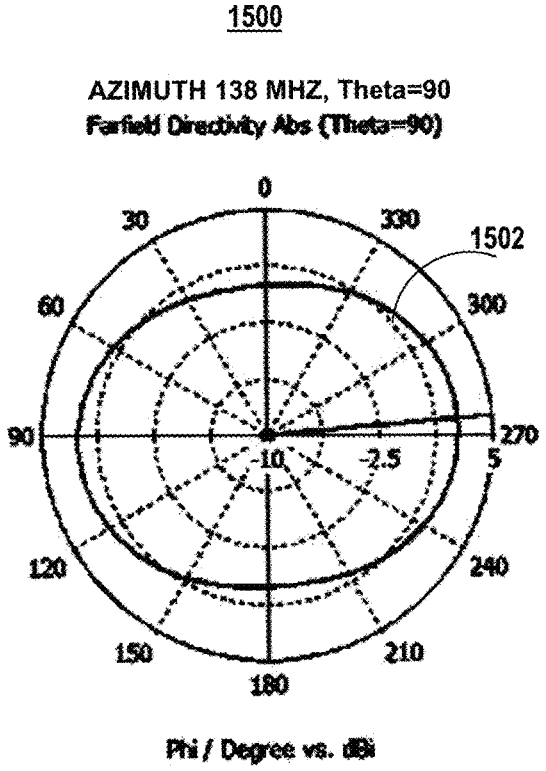
FIG. 15 is a graph including a polar plot of directivity vs azimuth angle in a third cut plane for then antenna shown in FIG. 10 when operating in the first mode.

FIG. 13 is a graph 1300 including a polar plot 1302 of directivity vs elevation angle in the X-Z plane for the antenna 1000 shown in FIG. 10 when operating in the first mode. The current distribution for the first mode at an instant in time is shown in FIG. 12. FIG. 14 is a graph 1400 including a polar plot 1402 of directivity vs elevation angle in the Y-Z plane for the antenna 1000 shown in FIG. 10 when operating in the first mode. FIG. 15 is a graph 1500 including a polar plot 1502 of directivity vs azimuth angle in the X-Y plane for then antenna 1000 shown in FIG. 10 when operating in the first mode. As illustrated in FIGS. 13-15 the first mode radiates similarly to a monopole antenna but with the orientation of the monopole tilted by a small angle from vertical.

Figure 16:
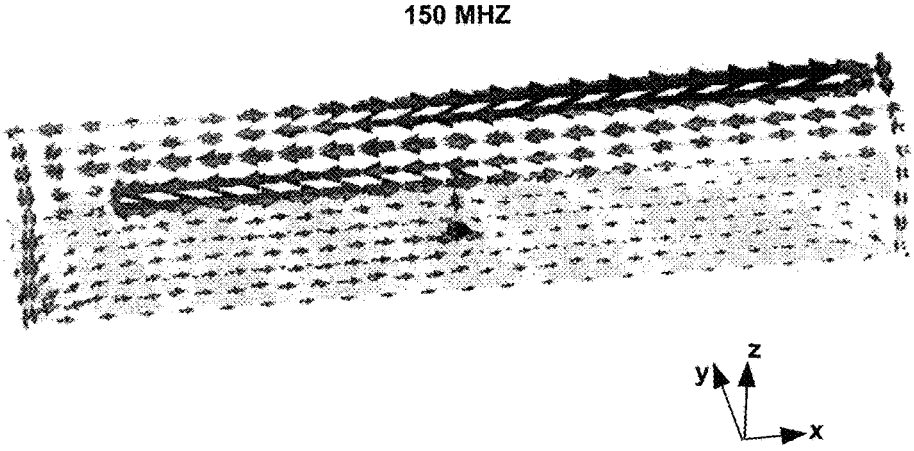
FIG. 16 shows a current distribution on the antenna shown in FIG. 10 at an instant in time for a second mode corresponding to a second frequency of operation.

FIG. 16 shows a current distribution on the antenna 1000 shown in FIG. 10 at an instant in time for a second mode corresponding to a second frequency (e.g., the 148-150 MHz band) of operation. In contrast to the first mode, for the second mode horizontal currents in the serpentine trace 1024 are a more significant contributor to the radiation pattern of the antenna 1000 than the conductive posts 1006, 1008, 1010.

Figure 17:
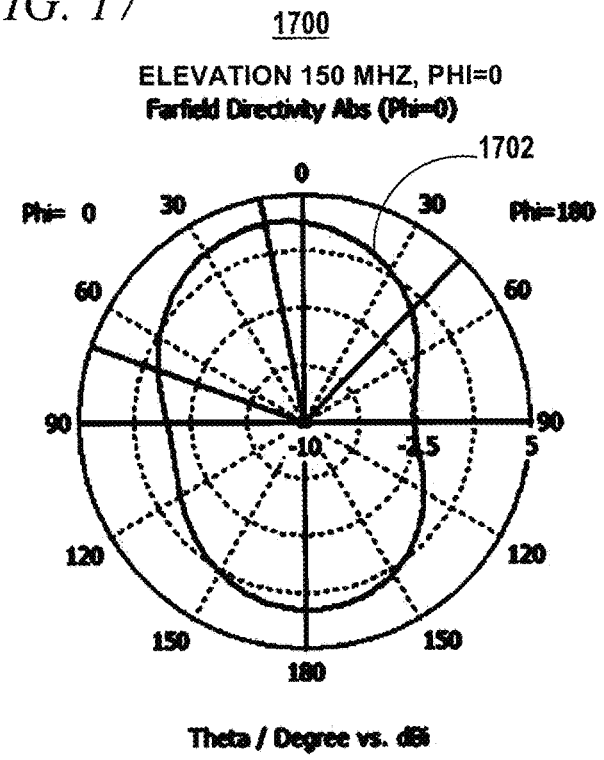
FIG. 17 is a graph including a polar plot of directivity vs elevation angle in the first cut plane for the antenna shown in FIG. 10 when operating in the second mode.
Figure 18:
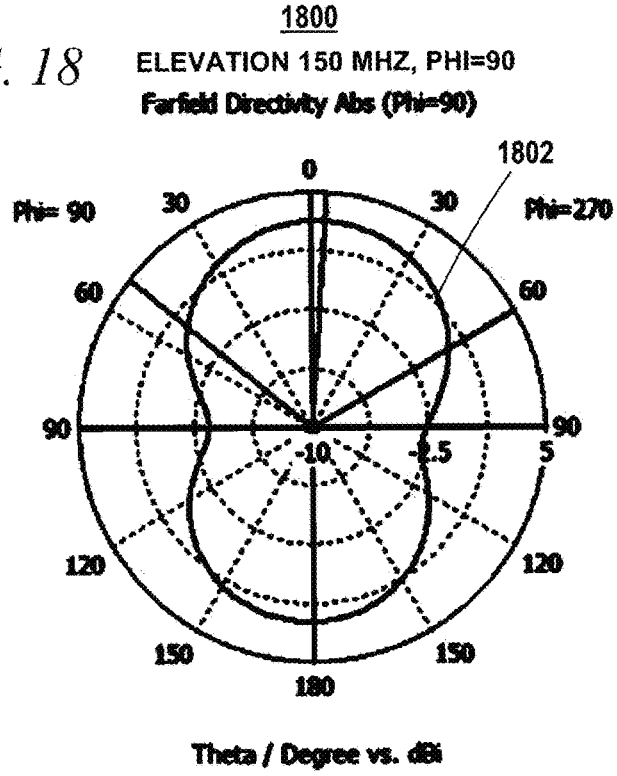
FIG. 18 is a graph including a polar plot of directivity vs elevation angle in the second cut plane for the antenna shown in FIG. 10 when operating in the second mode.
Figure 19:
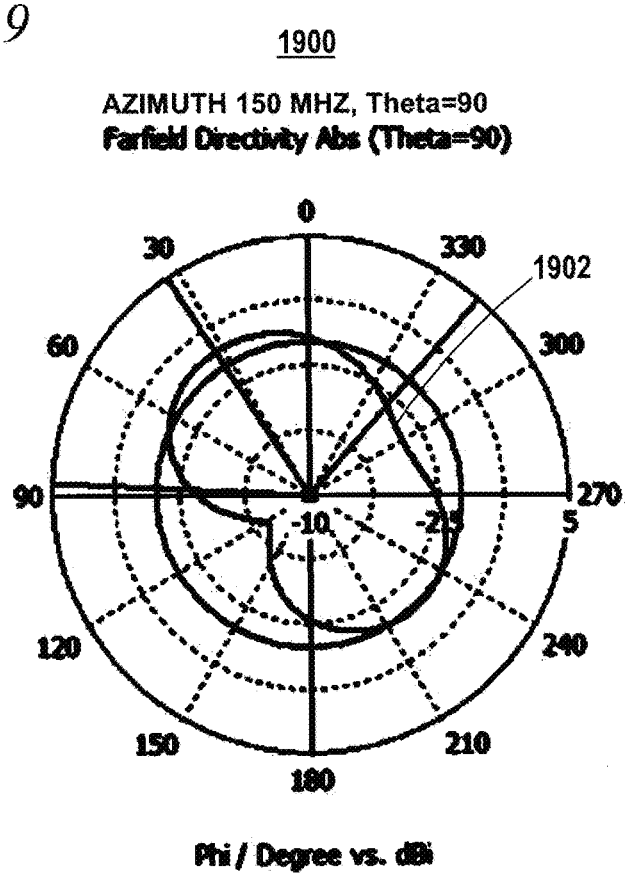
FIG. 19 is a graph including a polar plot of directivity vs azimuth angle in a third cut plane for the antenna shown in FIG. 10 when operating in the second mode.

FIG. 17 is a graph 1700 including a polar plot 1702 of directivity vs elevation angle in the X-Z cut plane for the antenna shown in FIG. 10 when operating in the second mode. FIG. 18 is a graph 1800 including a polar plot 1802 of directivity vs elevation angle in the Y-Z cut plane for the antenna shown in FIG. 10 when operating in the second mode. FIG. 19 is a graph 1900 including a polar plot 1902 of directivity vs azimuth angle in the X-Y cut plane for then antenna 1000 shown in FIG. 10 when operating in the second mode.

Figure 20:
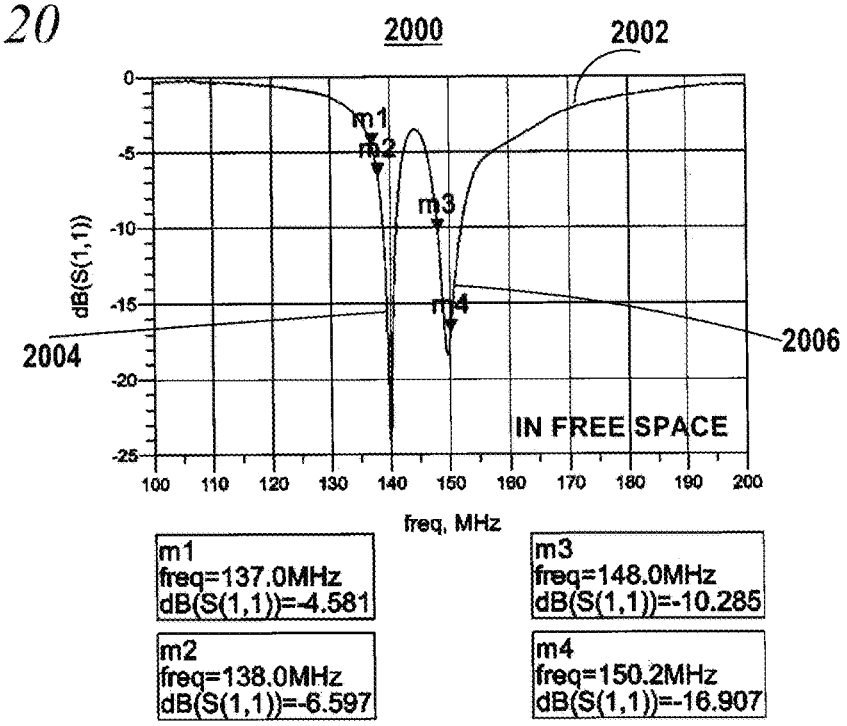
FIG. 20 is a graph including a return loss plot for the antenna shown in FIG. 10 when positioned in free space.
Figure 21:
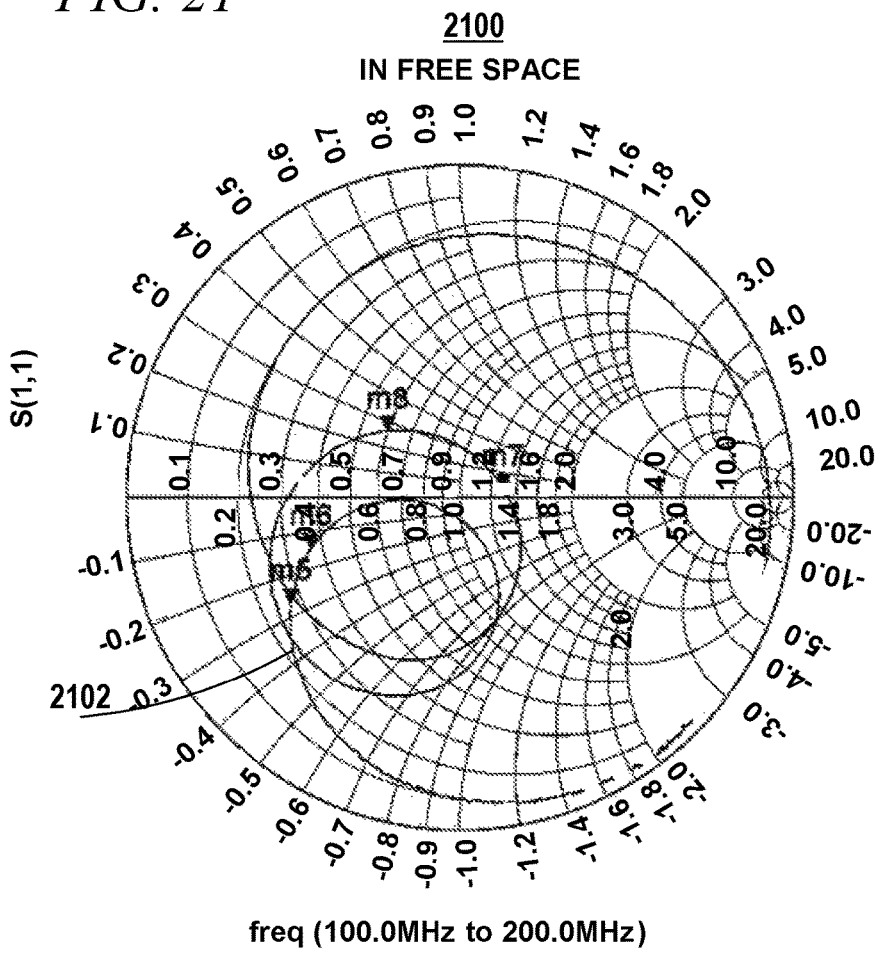
FIG. 21 is a fourth Smith chart showing the performance of the antenna shown in FIG. 10 when positioned in free space.

FIG. 20 is a graph 2000 including a return loss plot 2002 for the antenna shown in FIG. 10 when positioned in free space. The return loss plot 2002 exhibits a first resonance 2004 corresponding to the first mode and a second resonance 2006 corresponding to the second mode. FIG. 21 is a fourth Smith chart 2100 showing the performance of the antenna shown in FIG. 10 when positioned in free space. The fourth Smith chart 2100 includes a plot 2102 of operating point versus frequency.

In actuality the data shown in FIGS. 20-21 is for a version of the antenna 1000 that was optimized, by adjusting the length of the serpentine trace 1024, to perform best when positioned on an extended ground plane rather than free space. The ground plane tends to lower the frequency of operation, so in order to compensate the length of the serpentine trace 1024 is slightly reduced, e.g., by a few millimeters. In practice the large ground plane may take the form of the top of truck or shipping container, for example.

Figure 22:
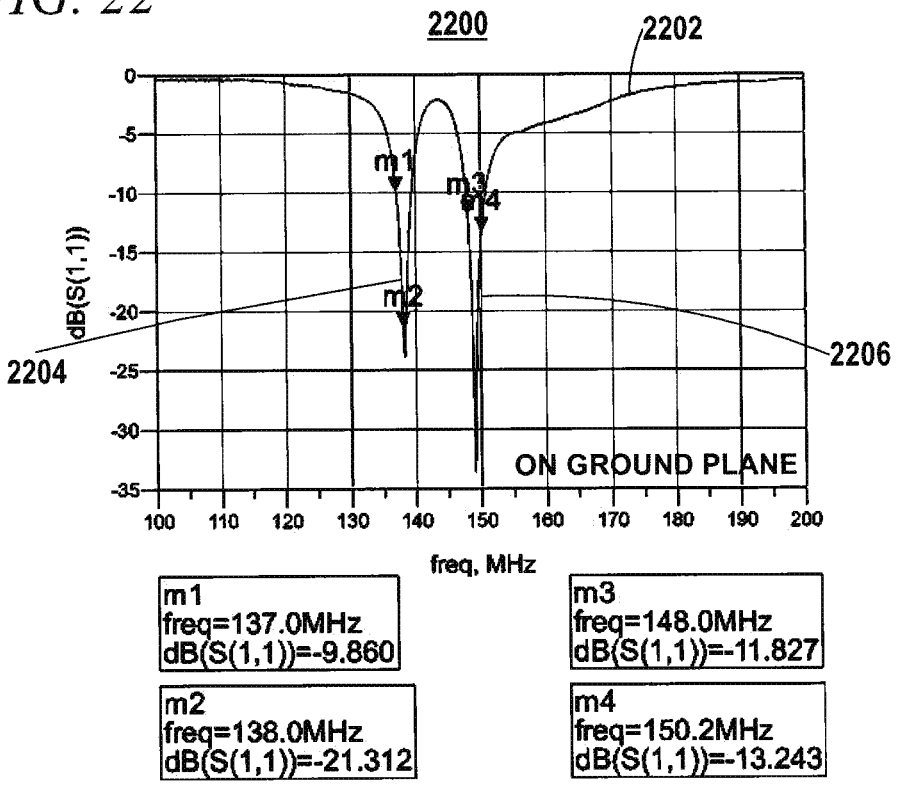
FIG. 22 is a graph including a return loss plot for the antenna shown in FIG. 10 when positioned on an extended ground plane.

FIG. 22 is a graph 2200 including a return loss plot 2202 for the antenna shown in FIG. 10 when positioned on an extended ground plane. As expected, the return loss plot 2202 also exhibits a first resonance 2204 corresponding to the first mode and a second resonance 2206 corresponding to the second mode. The first resonance 2204 overlaps the aforementioned 137-138 MHz frequency band and the second resonance 2206 overlaps the aforementioned 148-150 MHz frequency band. Comparing this return loss plot 2202 the return loss 902 shown in FIG. 9 which is for the antenna 100 shown in FIG. 1 equipped with the impedance matching network 400 shown in FIG. 4, it is evident that there is a better return loss for the 137-138 MHz frequency band and that there is a better return loss for the 148-150 MHz frequency band. Moreover the improved return loss is achieved without using matching network 400 which inherently introduces some additional losses into the system.

Figure 23:
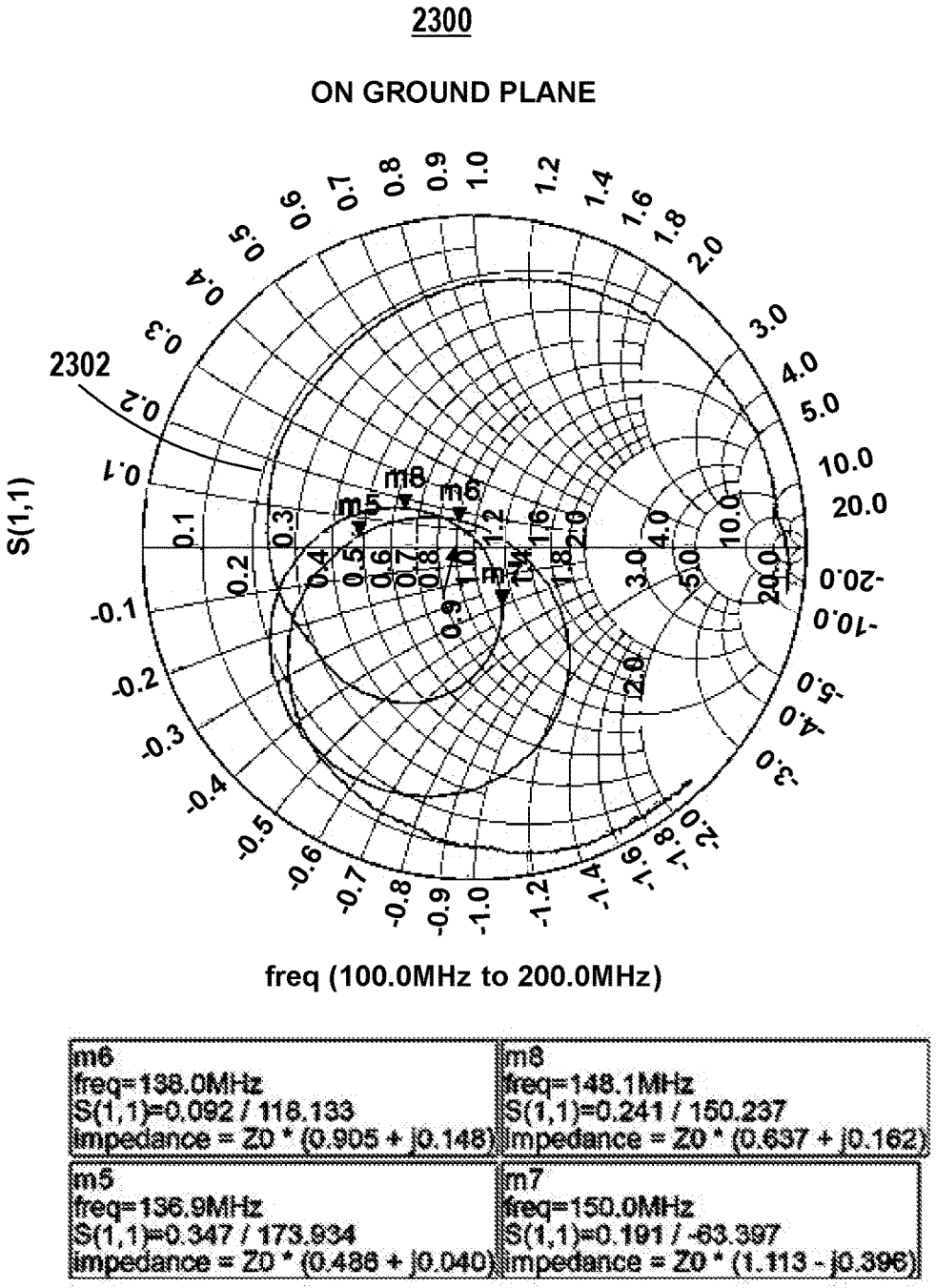
FIG. 23 is a fifth Smith chart showing the performance of the antenna shown in FIG. 9 when positioned on an extended ground plane.

FIG. 23 is a fifth Smith chart 2300 showing the performance of the antenna shown in FIG. 10 when positioned on the aforementioned extended ground plane. The fifth Smith chart 2300 includes a plot 2302 of operating point versus frequency. Comparing this Smith chart 2300 to the third Smith chart 700 which is for which is for the antenna 100 shown in FIG. 1 equipped with the impedance matching network 400 shown in FIG. 4 it is apparent that the frequency markers, as shown in the table presented above which denote the bounds of frequency bands of interest are, on average, significantly closer to the center of the fifth Smith chart 2300 than is the case for the third Smith chart 700. It is noted that the distance from the center of the Smith chart is indicative of the magnitude of the reflection coefficient from the antenna. Thus both the return loss plot 2202 shown in FIG. 22 and the fifth Smith chart 2300 demonstrate the improved performance of the antenna 1000 shown in FIG. 10.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

In the foregoing specification, specific embodiments of the present disclosure have been described. However, one of ordinary skill in the art appreciates that various modifications and changes can be made without departing from the scope of the present teachings as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. An antenna comprising:

a set of three parallel radiating posts including a first post, a second post and a third post, the first post having a first end including a signal coupling port, the second post and the third post each having first ends that are located on a same side as the first end of the first post, wherein the first ends of the second post and third post are coupled to a signal ground, the first post, the second post, and the third post each having second ends that are opposite the first ends, the second end of the first post and the second end of the second post being connected by a first run of serpentine conductor, the second end of the first post and the second end of the third post being connected by a second run of serpentine conductor, the first run of serpentine conductor and the second run of serpentine conductor extending in an oblong area having an oblong area length and an oblong area width that is measured in a direction transverse to the oblong area length and is shorter than the oblong area length, wherein the second post and the third post are positioned on a common first long side of the oblong area.

2. The antenna according to claim 1 further comprising an impedance transformation network coupled to the first end of the first post.

3. The antenna according to claim 2 wherein the impedance transformation network comprises a series inductor coupled to the first end of the first post, and a shunt inductor coupled through the series inductor to the first end of the first post.

4. The antenna according to claim 1 wherein a first distance between the second post and the third post being greater than both a second distance between the first post and the second post and a third distance between the first post and the third post.

5. The antenna according to claim 4 wherein the second distance is within 10% of the third distance.

6. The antenna according to claim 5 wherein the first run of serpentine conductor has a shape that is an equivalent to a rotation of the second run of serpentine conductor by 180 degrees about the first post.

7. The antenna according to claim 1 wherein the first run of serpentine conductor and second run of serpentine conductor are joined contiguously at the second end of said first post.

8. The antenna according to claim 1 wherein at least one of the first run of serpentine conductor and the second run of serpentine conductor has a conductor width that is between 0.05 and 0.1 times the oblong area width.

9. The antenna according to claim 1 wherein an electrical length of the first run of serpentine conductor is different than an electrical length of the second run of serpentine conductor.

10. The antenna according to claim 9 wherein the electrical length of the first run of serpentine conductor is at least a factor of 1.1 times the electrical length of the second run of serpentine conductor.

11. The antenna according to claim 10 wherein the electrical length of the first run of serpentine conductor is no more than a factor of 1.3 times the electrical length of the second run of serpentine conductor.

12. The antenna according to claim 9 wherein the first post is positioned at an intermediate position in a width direction of the oblong area between the common first long side of the oblong area and a second long side of the oblong area.

13. The antenna according to claim 9 wherein each of the first run of serpentine conductor and the second run of serpentine conductor includes at least two segments that span at least 75% of the oblong area length and the first run of serpentine conductor includes a segment that spans at least 75% of oblong area width.

14. An antenna comprising:

a set of three parallel radiating posts including a first post, a second post and a third post, the first post having a first end including a signal coupling port, the second post and the third post each having first ends that are located on a same side as the first end of the first post, wherein the first ends of the second post and third post are coupled to a signal ground, the first post, the second post, and the third post each having second ends that are opposite the first ends, the second end of the first post and the second end of the second post being connected by a first run of serpentine conductor, the second end of the first post and the second end of the third post being connected by a second run of serpentine conductor, the first run of serpentine conductor and the second run of serpentine conductor extending in an oblong area having an oblong area length and an oblong area width that is measured in a direction transverse to the oblong area length and is shorter than the oblong area length, the antenna further comprising a first board to which the first ends of the first post, the second post, and the third post are connected and a second board to which the second ends of the first post, the second post, and the third post are connected, the first run of serpentine conductor and the second run of serpentine conductor being disposed on the second board.

15. The antenna according to claim 14 wherein an electrical length of the first run of serpentine conductor is different than an electrical length of the second run of serpentine conductor.

16. The antenna according to claim 15 wherein the electrical length of the first run of serpentine conductor is at least a factor of 1.1 times the electrical length of the second run of serpentine conductor.

17. The antenna according to claim 16 wherein the electrical length of the first run of serpentine conductor is no more than a factor of 1.3 times the electrical length of the second run of serpentine conductor.

18. An antenna comprising:

a set of three parallel radiating posts including a first post, a second post and a third post, the first post having a first end including a signal coupling port, the second post and the third post each having first ends that are located on a same side as the first end of the first post, wherein the first ends of the second post and third post are coupled to a signal ground, the first post, the second post, and the third post each having second ends that are opposite the first ends, the second end of the first post and the second end of the second post being connected by a first run of serpentine conductor, the second end of the first post and the second end of the third post being connected by a second run of serpentine conductor, the first run of serpentine conductor and the second run of serpentine conductor extending in an oblong area having an oblong area length and an oblong area width that is measured in a direction transverse to the oblong area length and is shorter than the oblong area length, wherein a longitudinal component of a direction of a first path of the first run of serpentine conductor integrated over the path of the first run of serpentine conductor is at least 5 times a transverse component of the direction of the path of the first serpentine conductor; and a longitudinal component of a direction of a second path of the second run of serpentine conductor integrated over the path of the second run of serpentine conductor is at least 5 times a transverse component of the direction of the path of the second serpentine conductor, wherein the longitudinal component is parallel to the oblong area length and the transverse component is parallel to the oblong area width.

19. The antenna according to claim 18 wherein an electrical length of the first run of serpentine conductor is different than an electrical length of the second run of serpentine conductor.

20. The antenna according to claim 19 wherein the electrical length of the first run of serpentine conductor is at least a factor of 1.1 times the electrical length of the second run of serpentine conductor.

21. The antenna according to claim 20 wherein the electrical length of the first run of serpentine conductor is no more than a factor of 1.3 times the electrical length of the second run of serpentine conductor.

22. An antenna comprising:

a set of three parallel radiating posts including a first post, a second post and a third post, the first post having a first end including a signal coupling port, the second post and the third post each having first ends that are located on a same side as the first end of the first post, wherein the first ends of the second post and third post are coupled to a signal ground, the first post, the second post, and the third post each having second ends that are opposite the first ends, the second end of the first post and the second end of the second post being connected by a first run of serpentine conductor, the second end of the first post and the second end of the third post being connected by a second run of serpentine conductor, the first run of serpentine conductor and the second run of serpentine conductor extending in an oblong area having an oblong area length and an oblong area width that is measured in a direction transverse to the oblong area length and is shorter than the oblong area length, wherein a length of the first run of serpentine conductor is at least a factor of 1.1 times a length of the second run of serpentine conductor, wherein the length of the first run of serpentine conductor is no more than a factor of 1.3 times the length of the second run of serpentine conductor, wherein the second post and the third post are positioned on a common first long side of the oblong area.

23. The antenna according to claim 22 wherein the first post is positioned at an intermediate position in a width direction of the oblong area between the common first long side of the oblong area and a second long side of the oblong area.

24. An antenna comprising:

a set of three parallel radiating posts including a first post, a second post and a third post, the first post having a first end including a signal coupling port, the second post and the third post each having first ends that are located on a same side as the first end of the first post, and the first ends of the second post and third post coupled to a signal ground, the first post, the second post, and the third post each having second ends that are opposite the first ends, the second end of the first post and the second end of the second post being connected by a first run of serpentine conductor, the second end of the first post and the second end of the third post being connected by a second run of serpentine conductor, an impedance transformation network coupled to the first end of the first post, the impedance transformation network having a series inductor coupled to the first end of the first post, and a shunt inductor coupled through the series inductor to the first end of the first post.

25. The antenna according to claim 24 wherein:

a first distance between the second post and the third post being greater than both a second distance between the first post and the second post and a third distance between the first post and the third post.

* * * * *